US009304442B2

(12) United States Patent
Yamanaka

(10) Patent No.: US 9,304,442 B2
(45) Date of Patent: Apr. 5, 2016

(54) DEVELOPING DEVICE AND IMAGE FORMING APPARATUS INCLUDING THIS

(71) Applicant: KYOCERA Document Solutions Inc., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/593,113

(22) Filed: Jan. 9, 2015

(65) Prior Publication Data

US 2015/0198910 A1 Jul. 16, 2015

(30) Foreign Application Priority Data

Jan. 15, 2014 (JP) ..... 2014-005024

(51) Int. Cl.
*G03G 15/08* (2006.01)

(52) U.S. Cl.
CPC ..... *G03G 15/0889* (2013.01); *G03G 15/0856* (2013.01); *G03G 15/0891* (2013.01)

(58) Field of Classification Search
CPC ..... G03G 15/0889; G03G 15/0886; G03G 15/0891
See application file for complete search history.

(56) References Cited

U.S. PATENT DOCUMENTS

| | | | | |
|---|---|---|---|---|
| 5,113,227 | A * | 5/1992 | Miyasaka | 399/358 |
| 2009/0154972 | A1* | 6/2009 | Tanaka et al. | 399/358 |
| 2009/0214230 | A1* | 8/2009 | Kweon et al. | 399/27 |
| 2011/0243606 | A1* | 10/2011 | Okabe et al. | 399/119 |
| 2012/0170948 | A1* | 7/2012 | Kwon et al. | 399/30 |
| 2014/0205304 | A1* | 7/2014 | Yamanaka | 399/27 |

FOREIGN PATENT DOCUMENTS

JP 2009-020354 A 1/2009

* cited by examiner

*Primary Examiner* — David Gray
*Assistant Examiner* — Sevan A Aydin
(74) *Attorney, Agent, or Firm* — Studebaker & Brackett PC

(57) ABSTRACT

A developing device includes a case, an agitating member, a moving mechanism and a detecting device. The case contains a developer inside. The agitating member is rotated in the case to agitate the developer while conveying the developer in a rotation axis direction. The moving mechanism reciprocates the agitating member in the rotation axis direction in accordance with the rotation of the agitating member. The detecting device detects a developer amount contained in the case.

5 Claims, 10 Drawing Sheets

DEVELOPING DEVICE AND IMAGE FORMING APPARATUS INCLUDING THIS

INCORPORATION BY REFERENCE

This application is based on and claims the benefit of priority from Japanese Patent application No. 2014-005024 filed on Jan. 15, 2014, the entire contents of which are incorporated herein by reference.

BACKGROUND

The present disclosure relates to a developing device supplying a developer to an image carrier and an image forming apparatus including this.

Generally, an electrographic image forming apparatus emits a light based on image information to a circumference face of a photosensitive drum to form an electrostatic latent image. The image forming apparatus supplies a toner from a developing device to this electrostatic latent image to form a toner image, transfers the toner image onto a sheet, and then, carries out fixing process, thereby forming an image.

The developing device applied in the general image forming apparatus includes a case, a screw, a developing roller and a sensor. The screw conveys and agitates a developer contained in the case. The developing roller carries the developer and supplies it to the photosensitive drum. The sensor detects a developer amount in the case. The developer not supplied to the photosensitive drum when developing is returned into the case, agitated by the screw and used for developing, again.

If a deteriorated toner is adhered onto the screw, agitating and conveying functions of the screw are lowered. Therefore, in the general developing device, due to occurrence of charging failure of the developer in the case, sufficient developer cannot be conveyed to a developing roller or the like and image failure occurs.

For example, there is a developing device including a collision member colliding with a center part in an axis direction of a rotating supply chamber screw blade member. The developing device makes the collision member collide to vibrate the supply chamber screw blade member and to shake the deteriorated developer (toner) adhered onto the supply chamber screw blade member The above-mentioned developing device cannot provide strong vibration to an end part in the axis direction of the supply chamber screw blade member not colliding with the collision member. Therefore, in the end part in the axis direction of the supply chamber screw blade member, the developer adhered onto a rotation shaft of the supply chamber screw blade member agglomerates to cause so-called shaft thickening. When the shaft thickening occurs, the supply chamber screw blade member cannot suitably carry out developer conveyance. According to this, a conveyance amount of the developer is decreased. At this time, the sensor erroneously detects the decrease of the conveyance amount of the developer as the decrease of the developer amount even through the developer amount is not varied. Therefore, the above-mentioned developing device has a problem of not suitably maintaining the developer amount in the case.

SUMMARY

In accordance with an embodiment of the present disclosure, a developing device includes a case, an agitating member, a moving mechanism and a detecting device. The case contains a developer inside. The agitating member is rotated in the case to agitate the developer while conveying the developer in a rotation axis direction. The moving mechanism reciprocates the agitating member in the rotation axis direction in accordance with the rotation of the agitating member. The detecting device detects a developer amount contained in the case.

In accordance with an embodiment of the present disclosure, an image forming apparatus includes a developing device. The developing device includes a case, an agitating member, a moving mechanism and a detecting device. The case contains a developer inside. The agitating member is rotated in the case to agitate the developer while conveying the developer in a rotation axis direction. The moving mechanism reciprocates the agitating member in the rotation axis direction in accordance with the rotation of the agitating member. The detecting device detects a developer amount contained in the case.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
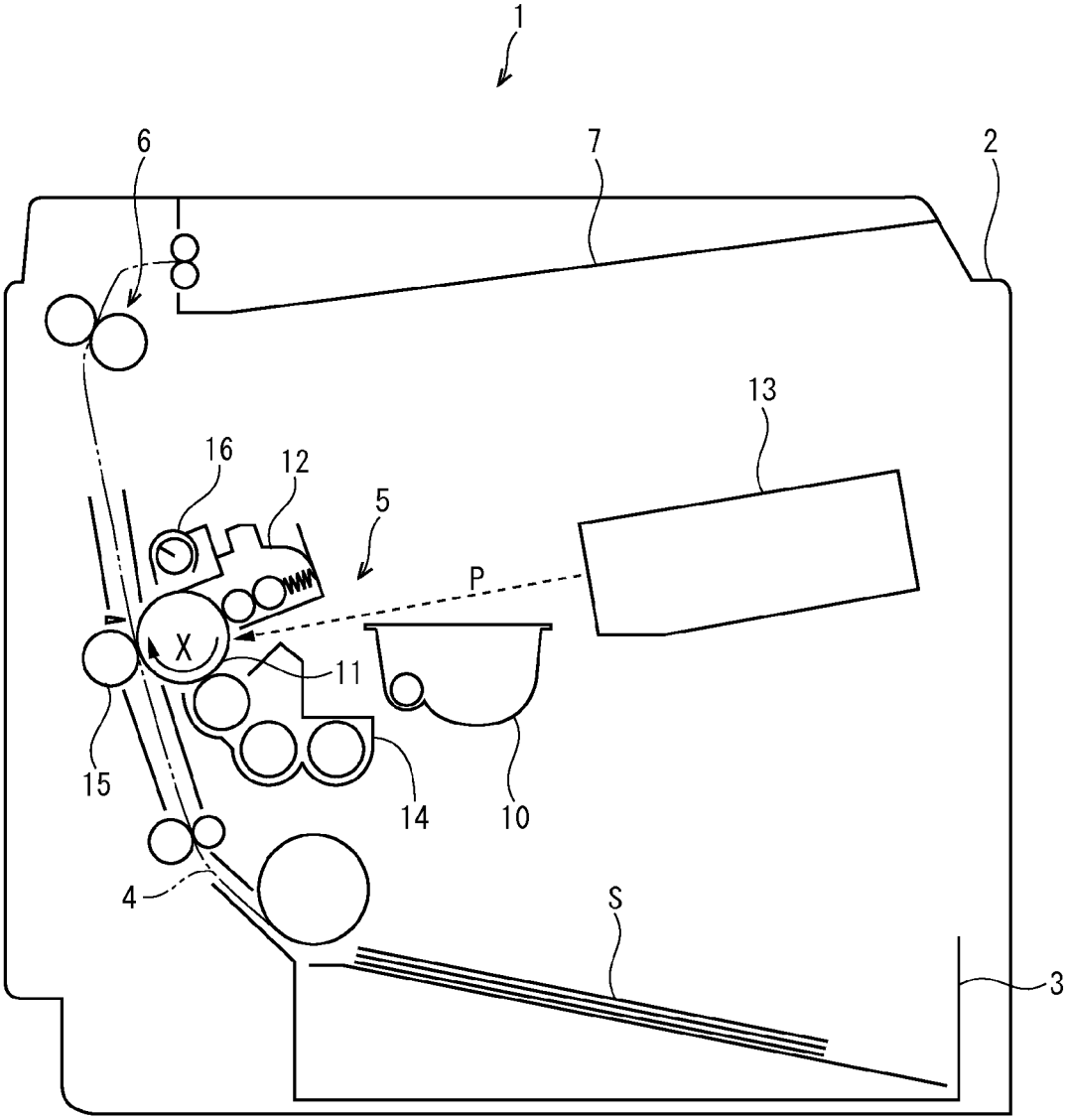
FIG. 1 is a sectional view schematically showing an inner structure of a printer in accordance with an embodiment of the present disclosure.

In the following, embodiments of the present disclosure will be described with reference to the appended drawings. First, with reference to FIG. 1, an entire structure of a printer 1 as an image forming apparatus will be described. FIG. 1 is a schematic diagram schematically showing an inner structure of the printer 1.

The printer 1 includes a sheet feeding cartridge 3, an image forming part 5, a fixing device 6 and an ejected sheet tray 7. The sheet feeding cartridge 3 stores a sheet S inside a roughly box-like formed apparatus main body 2. The image forming part 5 transfers a toner image onto the sheet S fed from the sheet feeding cartridge 3 to a conveyance path 4. The fixing device 6 fixes the transferred toner image onto the sheet S. The ejected sheet tray 7 is an ejection destination of the sheet S after fixing. The sheet S is not restricted by a paper-made sheet, may be a resin film, an OHP (OverHead Projector) sheet or the like.

The image forming part 5 includes a developer case 10 containing a developer with a replenishment toner and a photosensitive drum 11 as an image carrier. The image forming part 5 also includes a charging roller 12, an exposure device 13, a developing device 14, a transferring roller 15 and a cleaning device 16 arranged around the photosensitive drum 11 in transferring process order (refer to an arrow X in FIG. 1). The developing device 14 contains a predetermined amount of one-component developer (hereinafter, called as a "developer") consisting of a magnetic toner or the like.

Now, the operation of the printer 1 will be described. When the power is supplied to the printer 1, initialization of various parameters and others are carried out. In the printer 1, when image data is inputted from a personal computer or the like connected with the printer 1 and a printing start is directed, image forming process is carried out as follows.

First, to a surface of the photosensitive drum 11 charged at a predetermined electrical potential by the charging roller 12, exposure (refer to an arrow P in FIG. 1) corresponding to the image data is carried out by the exposure device 13. An electrostatic latent image thereby formed onto the photosensitive drum 11 is developed to the toner image by the developer supplied from the developer case 10 to the developing device 14.

On the other hand, the sheet S fed from the sheet feeding cartridge 3 is conveyed between the photosensitive drum 11 and transferring roller 15 through the conveyance path 4. When a transferring bias is applied to the transferring roller 15, the toner image is transferred onto the sheet S. The toner image transferred onto the sheet S is fixed onto the sheet by the fixing device 6. The sheet S is ejected to the ejected sheet tray 7 after fixing process in the fixing device 6. The developer remained on the photosensitive drum 11 after transferring is removed by the cleaning device 16.

Figure 2:
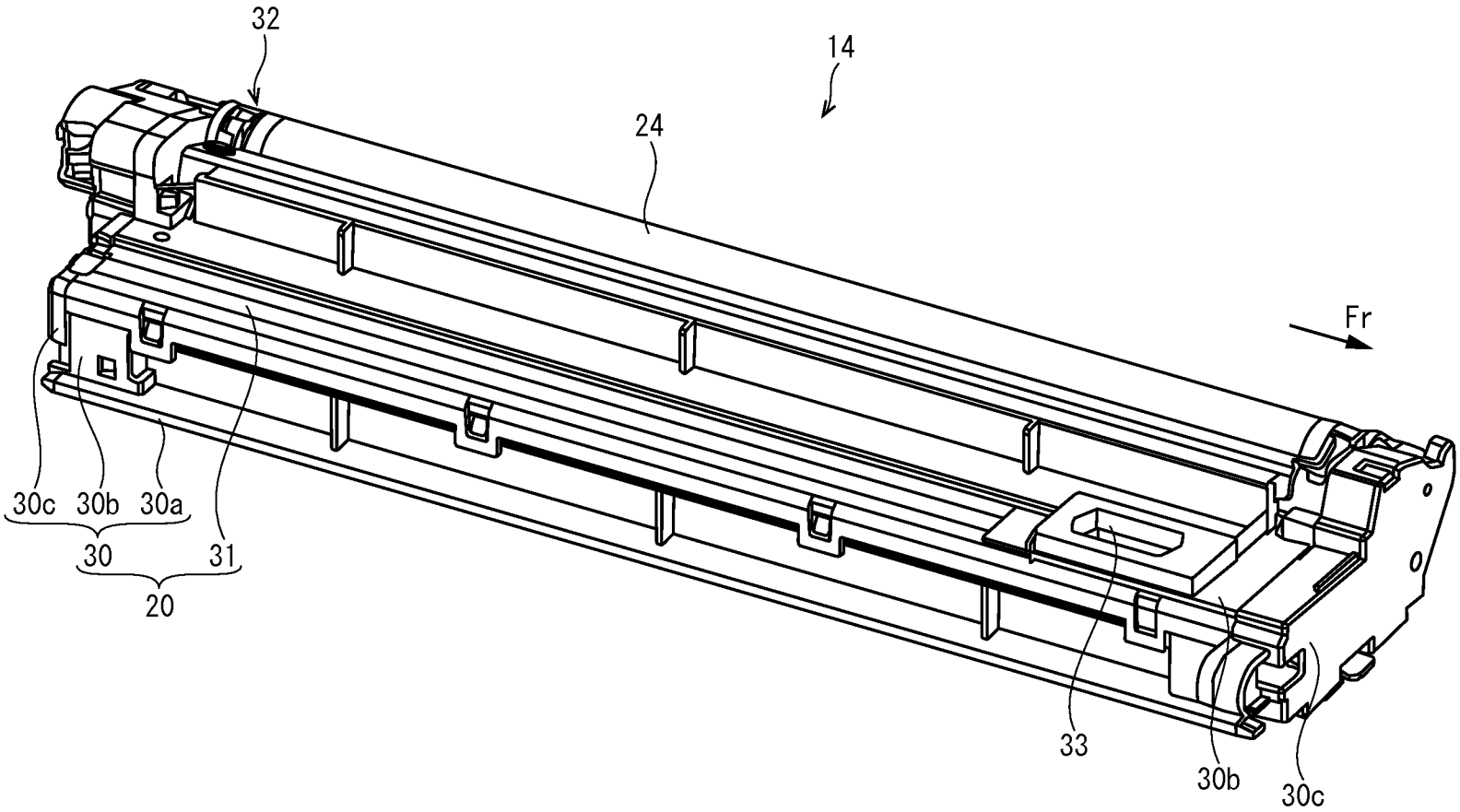
FIG. 2 is a perspective view showing a developing device in accordance with the embodiment of the present disclosure.
Figure 3:
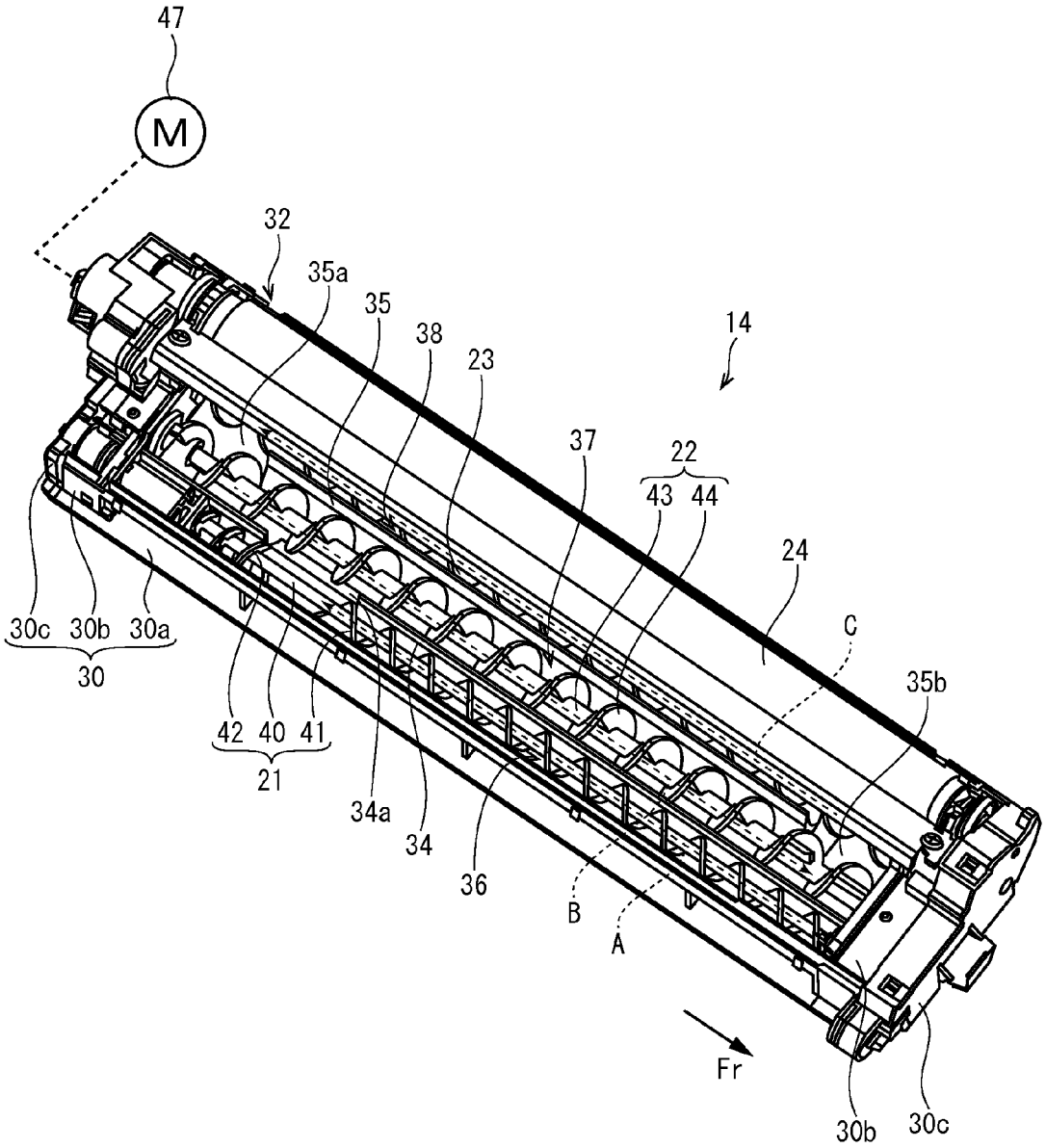
FIG. 3 is a perspective view showing the developing device in a condition, where a lid part is opened, in accordance with the embodiment of the present disclosure.
Figure 4:
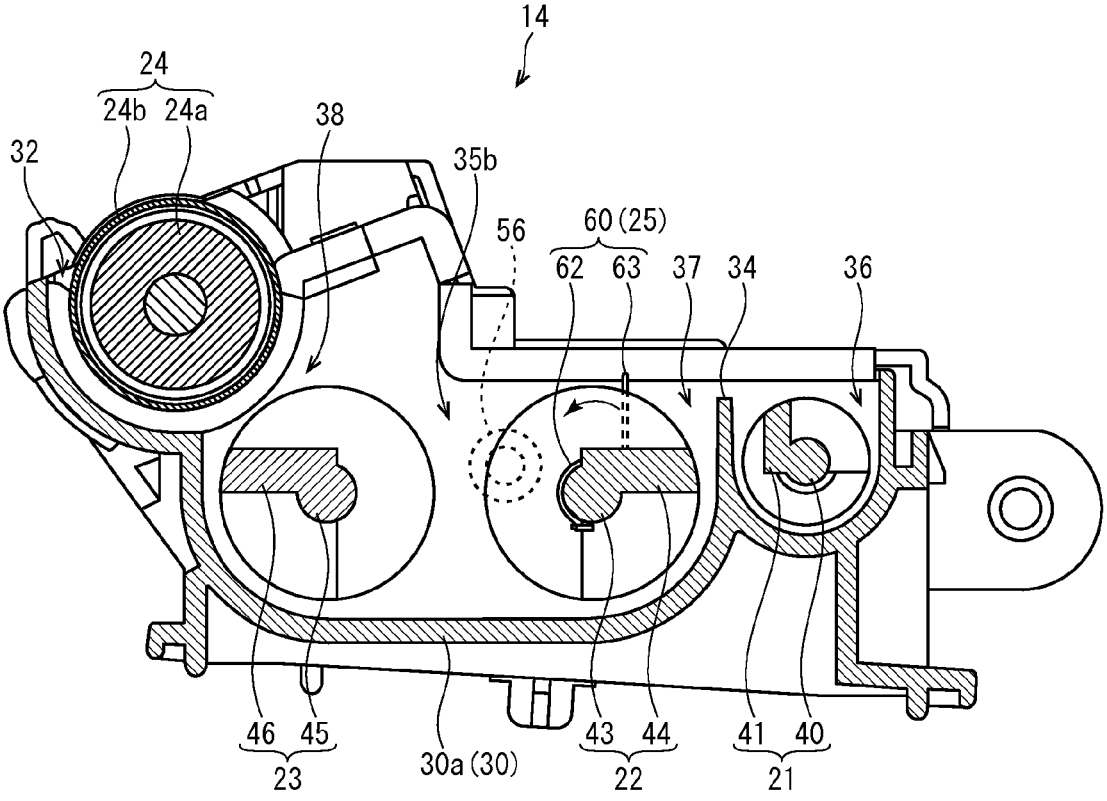
FIG. 4 is a sectional view showing the developing device in accordance with the embodiment of the present disclosure.
Figure 5:
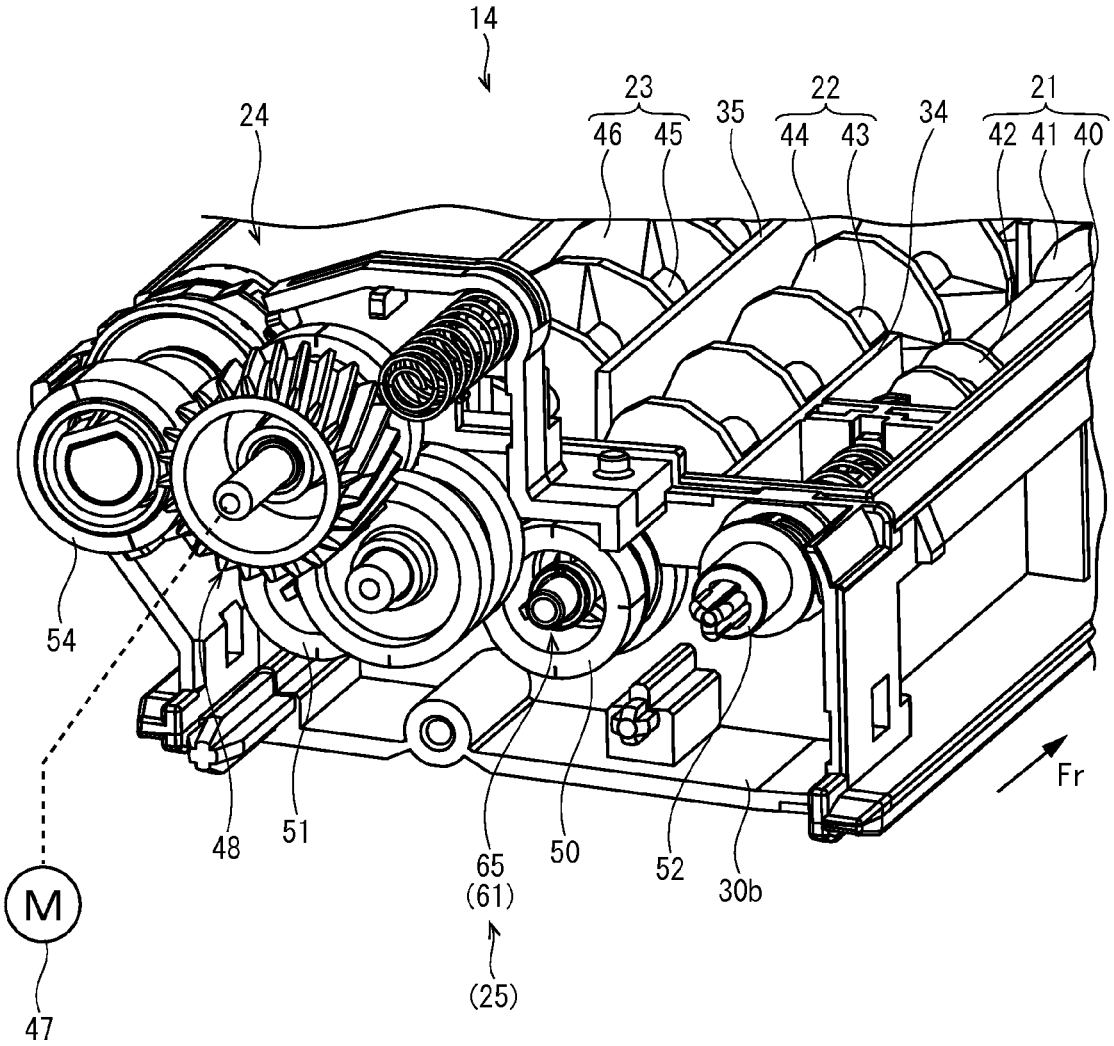
FIG. 5 is a perspective view showing a rear end part of the developing device in accordance with the embodiment of the present disclosure.

Next, with reference to FIGS. 2 to 5, the developing device 14 will be described. FIG. 2 is a perspective view showing the developing device 14. FIG. 3 is a perspective view showing the developing device 14 in a condition, where a lid part 31 is opened. FIG. 4 is a sectional view showing the developing device 14. FIG. 5 is a perspective view showing a rear end part of the developing device 14. In the following description, an arrow Fr in each figure indicates the front side, for convenience.

The developing device 14 includes a housing 20, a conveying screw 21, a first agitating screw 22, a second agitating screw 23, a developing roller 24, a moving mechanism 25 and a detecting device 26. The housing 20 contains the developer inside. The conveying screw 21, first agitating screw 22 and second agitating screw 23 are rotated in the housing 20 to agitate the developer while conveying the developer in the housing 20 in a rotation axis direction (forward and backward directions). The developing roller 24 is arranged so as to face to the photosensitive drum 11. The moving mechanism 25 reciprocates the first agitating screw 22 in the rotation axis direction in accordance with the rotation of the first agitating screw 22 (refer to FIG. 5 and other figures). The detecting device 26 detects an amount of the developer contained in the housing 20 (refer to FIG. 6).

As shown in FIGS. 2 and 3, the housing 20 as a case is formed in a roughly rectangular parallelepiped shape elongated in the forward and backward directions. The housing 20 has a housing main body 30 and a lid part 31. The housing main body 30 is formed in a roughly box-like shape with an opened upper face. The lid part 31 is arranged so as to cover the opened upper face of the housing main body 30.

The housing main body 30 has a pair of lateral wall parts 30*b* and a pair of front and rear covers 30*c*. The pair of lateral wall parts 30*b* are vertically arranged on both end parts in the forward and backward directions of a bottom part 30*a*. The pair of front and rear covers 30*c* are arranged so as to cover the respective lateral wall parts 30*b* from the outside.

In the housing main body 30 in a condition where the lid part 31 is attached, an opening part 32 is formed at a right side facing to the photosensitive drum 11. At a left rear side of the lid part 31, a supply port 33 connected to the developer case 10 is formed. The developer supplied from the developer case 10 is supplied to the inside of the housing 20 though the supply port 33.

As shown in FIGS. 3 and 4, on the bottom part 30*a* of the housing main body 30, a first partition wall 34 and a second partition wall 35 extending in the forward and backward directions are vertically arranged. The inside of the housing main body 30 is partitioned into a supply conveyance path 36, a first conveyance path 37 and a second conveyance path 38 by the first partition wall 34 and second partition wall 35. The conveyance paths 36, 37 and 38 are arranged in parallel to each other. In the front side of the first partition wall 34, a conveyance communicating part 34*a* communicating the supply conveyance path 36 and first conveyance path 37 is formed. In both end parts in a longitudinal direction of the second partition wall 35, an upstream side communicating part 35*a* and a downstream side communicating part 35*b* communicating the first conveyance path 37 and second conveyance path 38 are formed. In the embodiment, the upstream side and downstream side are determined on the basis of a conveying direction (refer to an arrow B in FIG. 3) of the developer in the first conveyance path 37.

The conveying screw 21 is configured by fixing a helical screw blade 41 protruded in a radial direction onto a circumference face of a rotation shaft part 40. The conveying screw 21 is arranged in the supply conveyance path 36. The rotation shaft part 40 is extended in the forward and backward directions and rotatably supported by the pair of front and rear lateral wall parts 30*b*. The screw blade 41 is provided from a front end part of the rotation shaft part 40 to the vicinity of the conveyance communicating part 34*a*. At the back side of the conveyance communicating part 34*a*, a reverse helical blade 42 with an opposite phase to the screw blade 41 is provided.

The first agitating screw 22 and second agitating screw 23 are respectively configured by fixing helical screw blades 44 and 46 protruded in a radial direction onto circumference faces of rotation shaft parts 43 and 45. The first agitating screw 22 is arranged in the first conveyance path 37 and the second agitating screw 23 is arranged in the second conveyance path 38. The rotation shaft parts 43 and 45 are extended in the forward and backward directions and rotatably supported by the pair of front and rear lateral wall parts 30*b*. The screw blades 44 and 46 are provided to positions facing to the upstream side communicating part 35*a* and downstream side communicating part 35*b*, respectively. The screw blade 44 is formed at the same pitch as the screw blade 46 so as to have an opposite phase to the screw blade 41 and screw blade 46.

As shown in FIG. 4, the developing roller 24 has a magnetic pole member 24*a* and a developing sleeve 24*b*. The magnetic pole member 24*a* is extended in the forward and backward directions and unrotatably supported by the pair of front and rear lateral wall parts 30*b*. The developing sleeve 24*b* is formed in a cylindrical shape so as to enclose the magnetic pole member 24*a*. The developing sleeve 24*b* is extended in the forward and backward directions and rotatably supported by the pair of front and rear lateral wall parts 30*b*. The developing roller 24 (the developing sleeve 24*b*) is arranged inside the housing main body 30 so as to have an upper part exposed from the opening part 32. The exposed upper part of developing roller 24 is arranged so as to face to the photosensitive drum 11 at a slight gap.

As shown in FIGS. 3 and 5, the developing roller 24, and the conveying roller 21, first agitating screw 22 and second agitating screw 23 as agitating members are driven and rotated by a single driving device 47. The driving device 47 as a driving part includes an electric motor and others. Rear end parts of the rotation shaft parts 40, 43, 45 of the respective screw 21, 22, 23 are extended backwardly from the lateral wall part 30*b*. To the rear end parts of the rotation shaft parts 40, 43, 45, gears 50, 51 and others transmitting a rotation force from the driving device 47 via an output gear train 48 are attached. Moreover, to the rear end part of the rotation shaft part 40, a conveyance drive inputting part 52 connected to a connecting device (not shown) is attached. To a rear end part of the developing sleeve 24*b*, a gear 54 meshing with the output gear train 48 of the driving device 47 is attached. To the rear lateral wall part 30*b*, the cover 30*c* is attached so as to cover the output gear train 48 and the gears 50, 51 and others (refer to FIG. 2).

Now, an action of the developing device 14 will be described. The developer is supplied from the developer case 10 to the supply conveyance path 36 via the supply port 33. The conveying screw 21 is driven and rotated by the driving device 47 via the conveyance drive inputting part 52. The developer is agitated and conveyed backwardly in the supply conveyance path 36 by the rotation of the conveying screw 21 (refer to an arrow A in FIG. 3). The backwardly conveyed developer is blocked by the rotation of the reverse helical blade 42 and supplied to the first conveyance path 37 through the conveyance communicating part 34*a* of the first partition wall 34.

The first agitating screw 22 and second agitating screw 23 are driven and rotated by the driving device 47. The developer is agitated and conveyed forwardly in the first conveyance path 37 by the rotation of the first agitating screw 22 (refer to the arrow B in FIG. 3). The developer conveyed to a front end is supplied to the second conveyance path 38 through the downstream side communicating part 35*b* of the second partition wall 35. The developer is agitated and conveyed backwardly in the second conveyance path 38 by the rotation of the second agitating screw 23 (refer to the arrow C in FIG. 3). The developer conveyed to a rear end is supplied to the first conveyance path 37 again through the upstream side communicating part 35*a* of the second partition wall 35. That is, the developer circulates through the first conveyance path 37 and second conveyance path 38.

The developing roller 24 (the developing sleeve 24*b*) is driven and rotated by the driving device 47. The developer charged by agitating and circulating is conveyed to the developing roller 24 by the second agitating screw 23. Thereby, the developer is carried by the surface of the developing roller 24 and conveyed to the opening part 32 in accordance with the rotation of the developing roller 24. To the developing roller 24, a predetermined developing bias is applied. Thereby, the carried developer is supplied to the photosensitive drum 11 and the electrostatic latent image formed on the surface of the photosensitive drum 11 is developed. The developer not used for developing (a redundant developer) is returned to the second conveyance path 38 to circulate through the first conveyance path 37 and second conveyance path 38. Incidentally, the housing 20 includes a blade (not shown) regulating a layer thickness of the developer carried by the surface of the developing roller 24.

As mentioned above, the developing device 14 includes the moving mechanism 25 and detecting device 26. The moving mechanism 25 is provided in order to shake a deteriorated developer adhered onto the first agitating screw 22. The detecting device 26 is provided in order to detect the developer amount contained in the first conveyance path 37 and second conveyance path 38.

Figure 6:
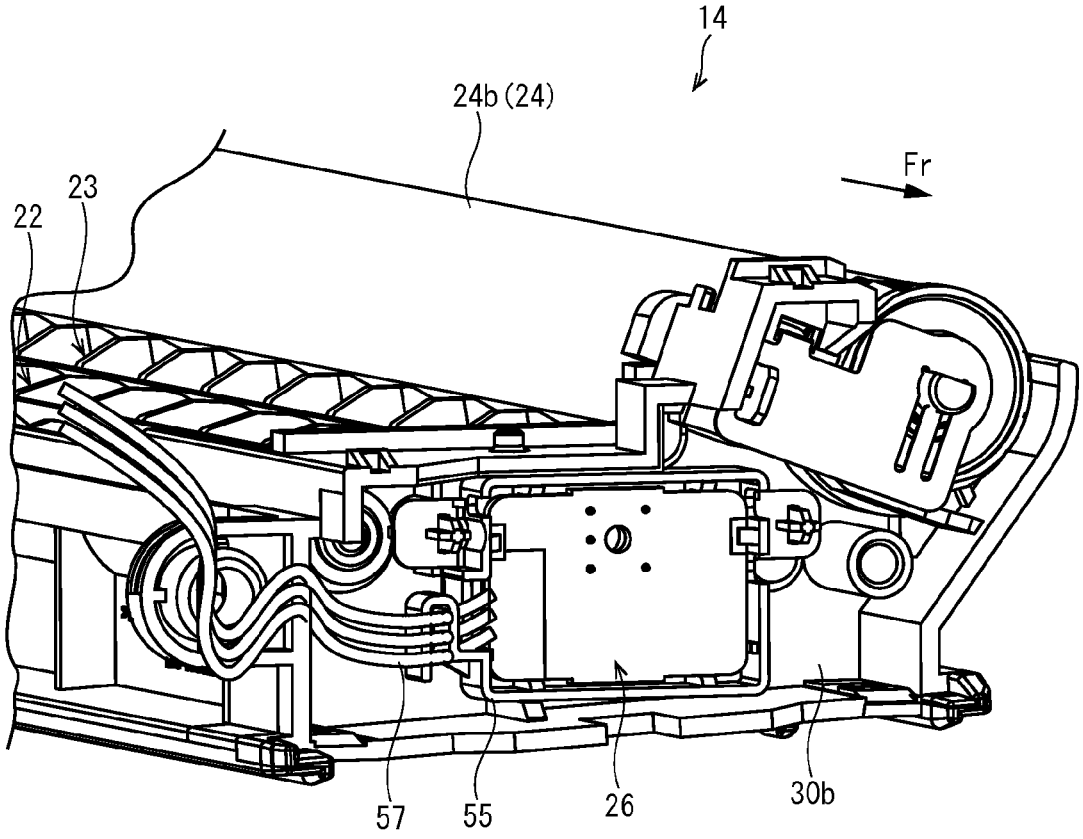
FIG. 6 is a perspective view showing the outside of a front end part of the developing device in accordance with the embodiment of the present disclosure.
Figure 7:
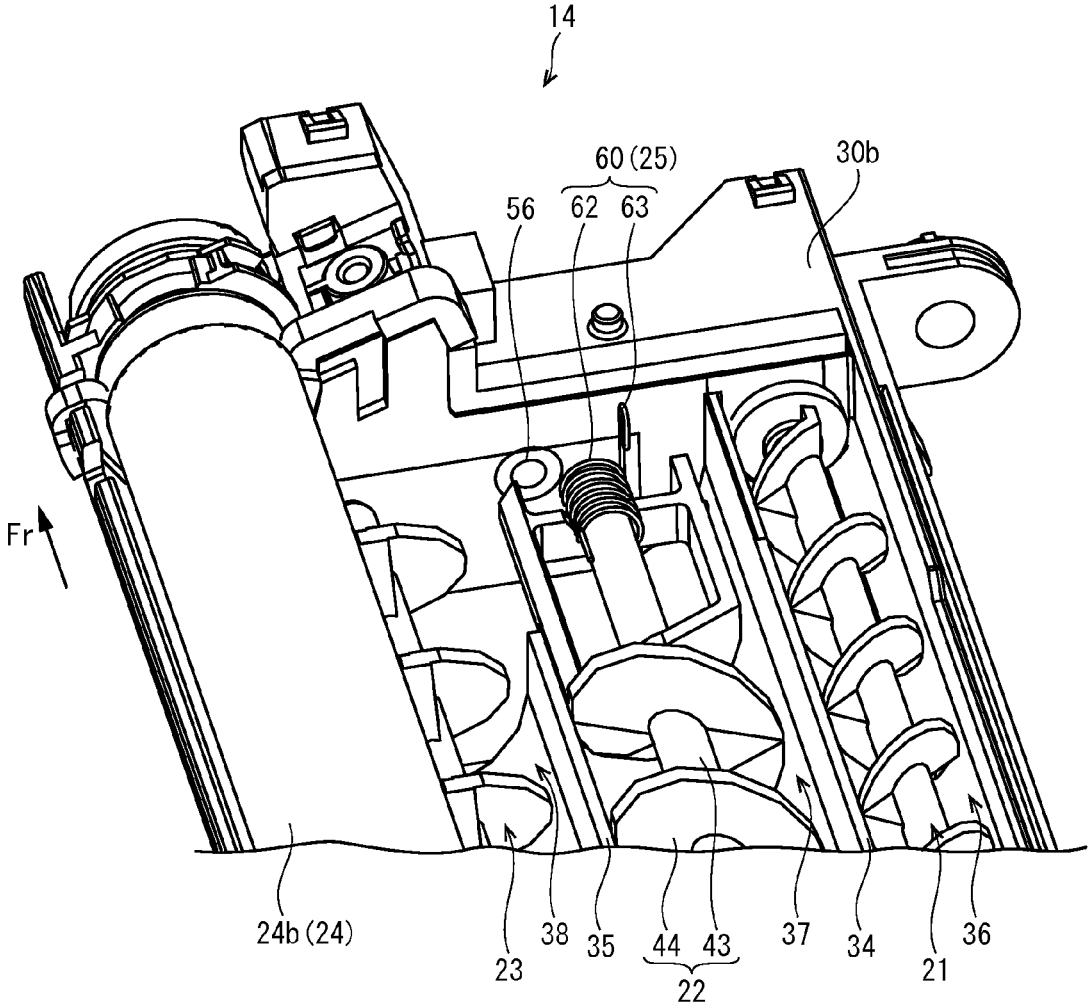
FIG. 7 is a perspective view showing the inside of the front end part of the developing device in accordance with the embodiment of the present disclosure.

With reference to FIGS. 4, 6 and 7, before the description of the moving mechanism 25, the detecting device 26 will be described. FIGS. 6 and 7 are perspective views showing a front end part of the developing device 14.

As shown in FIG. 6, the detecting device 26 includes, for example, a permeability sensor (not shown) supported by a sensor frame 55 formed in a roughly rectangular shape. The detecting device 26 is configured so as to measure permeability of the developer by the permeability sensor and to detect the developer amount according to the measured result. The detecting device 26 is arranged at one side (the front side) in the rotation axis direction of the housing main body 30. In detail, the detecting device 26 is attached to a front face of the front lateral wall part 30*b*. Incidentally, to the front lateral wall part 30*b*, the cover 30*c* is attached so as to cover the detecting device 26 and others (refer to FIG. 2).

As shown in FIGS. 4 and 7, the detecting device 26 is arranged so that a detection face 56 of the permeability sensor is positioned between the first agitating screw 22 and second agitating screw 23 (accurately, at a side of the first agitating screw 22). FIGS. 4 and 7 illustrate the detection face 56, for convenience of the description, but the detection face 56 is not exposed from an inside face of the lateral wall part 30*b* in actuality. The detecting device 26 outputs the detected result (signal) by the permeability sensor to a controlling device (not shown) connected to the printer 1 via a wiring 57 (refer to FIG. 6). Thereby, the controlling device can decide excess and deficiency of the developer amount contained inside the developing device 14 (the housing 20).

Figure 8:
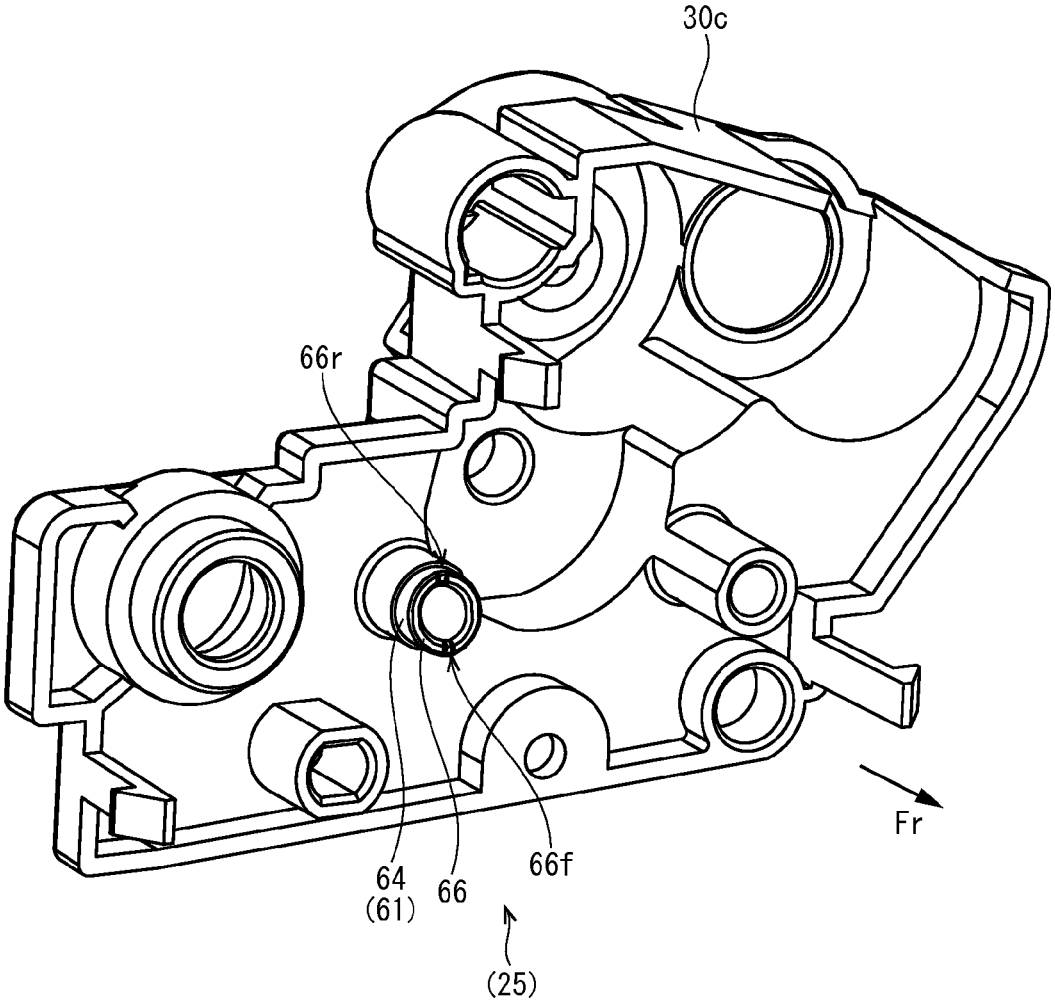
FIG. 8 is a perspective view showing a cover of the developing device in accordance with the embodiment of the present disclosure.
Figure 9:
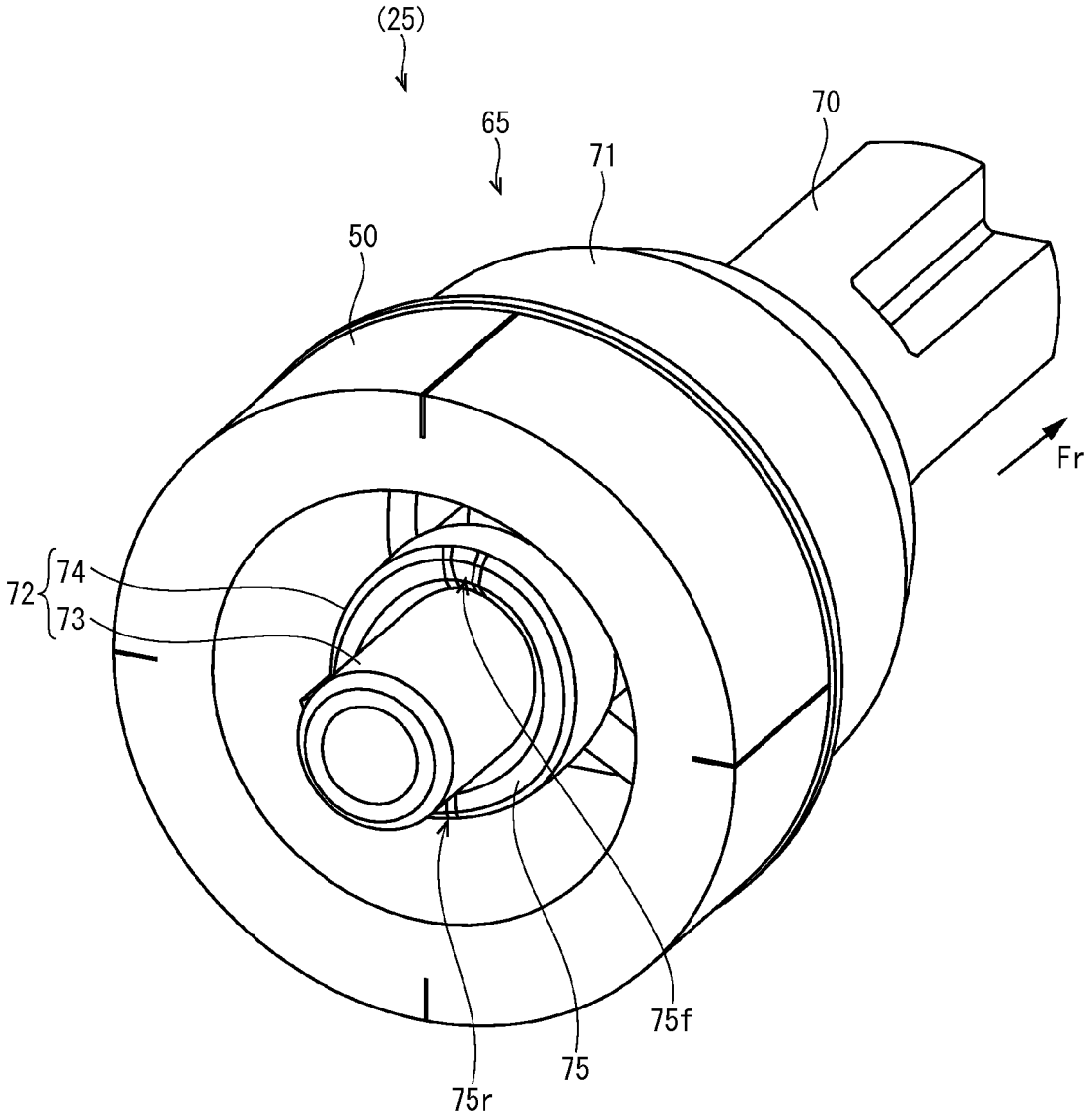
FIG. 9 is a perspective view showing a fitting part of the developing device in accordance with the embodiment of the present disclosure.

Next, with reference to FIGS. 4, 5, 7 to 9, the moving mechanism 25 will be described. FIG. 8 is a perspective view showing the cover 30*c* of the developing device 14. FIG. 9 is a perspective view showing a fitting part 65 of the developing device 14.

The moving mechanism 25 has a biasing member 60 and a displacing member 61. The biasing member 60 is arranged in front of the first agitating screw 22 so as to bias the first agitating screw 22 to another side (the rear side) in the rotation axis direction (refer to FIG. 7). The displacing member 61 is arranged in the rear of the first agitating screw 22 so as to displace the first agitating screw 22 in the rotation axis direction in accordance with the rotation of the first agitating screw 22 (refer to FIG. 5).

As shown in FIGS. 4 and 7, the biasing member 60 has a coil part 62 and a cleaning part 63. The coil part 62 is formed by helically coiling a wire. The coil part 62 is attached to the rotation shaft part 43 of the first agitating screw 22 so as to make a bias force act on the first agitating screw 22. The cleaning part 63 is extended from the coil part 62 to the outside in the radial direction so as to clean the detection face 56 of the detecting device 26 in accordance with the rotation of the first agitating screw 22. The coil part 62 and cleaning part 63 are formed in a body by one metal wire with elasticity.

The coil part 62 is a so-called coil spring consisting of a helical coiled wire. Into the coil part 62, the rotation shaft part 43 of the first agitating screw 22 is loosely inserted. The coil part 62 is locked to the rotation shaft part 43 by engaging an engaging part (not shown) formed in a rear end part with an end part of the screw blade 44. The coil part 62 is formed so that a length in an axial direction is longer than a distance between the end part of the screw blade 44 and front lateral wall part 30*b*. Thereby, the coil part 62 biases the first agitating screw 22 backwardly with regard to the front lateral wall part 30*b* as a pedestal.

The cleaning part 63 is extended in an orthogonal direction to an axial center of the first agitating screw 22 from the front end part of the coil part 62 coming into contact with the lateral wall part 30*b*. The cleaning part 63 is formed in a linear shape so as to reach the detection face 56 of the detecting device 26 from the coil part 62. A distal end of the cleaning part 63 is folded back so as to be formed in an U-shape projected upwardly.

As shown in FIGS. 5, 8 and 9, the displacing member 61 has a fixing shaft 64 and a fitting part 65. The fixing shaft 64 is protruded forwardly from the cover 30*c* of the housing 20. The fitting part 65 is arranged in a rear end part of the first agitating screw 22.

As shown in FIG. 8, the fixing shaft 64 is protruded on an inside face (a front face) of the rear cover 30*c*. The fixing shaft 64 is formed in a roughly hollow cylindrical shape. In a distal end part of the fixing shaft 64, a circular distal end face 66 is formed. The distal end face 66 is formed so as to be inclined downwardly to the front side. Incidentally, the rear cover 30*c* has a plurality of bearings rotatably supporting the output gear train 48 of the driving device 47, gears 50, 51 and conveyance drive inputting part 52. The cover 30*c* with the fixing shaft 64 is formed in a body, for example, by ABS resin (Acrylonitrile-Butadiene-Styrene copolymer synthetic resin).

As shown in FIG. 9, the fitting part 65 has a screw fitting shaft part 70, a gear holding part 71 and a fitting part main body 72. The screw fitting shaft part 70 is formed in a roughly cylindrical shape. The gear holding part 71 is arranged in a rear end part of the screw fitting shaft part 70. The fitting part main body 72 is extended to the back side of the gear holding part 71. The screw fitting shaft part 70, gear holding part 71 and fitting part main body 72 have the same axial center and are formed in a body, for example, by POM resin (Polyacetal resin) with excellent slidability.

The screw fitting shaft part 70 penetrates the rear lateral wall part 30*b* and is fitted and fixed into an axial center (a hollow portion) of the rotation shaft part 43 of the first agitating screw 22 (refer to FIG. 5).

The gear holding part 71 is formed in a roughly cylindrical shape having a diameter larger than the screw fitting shaft part 70. The gear holding part 71 has a taper part, which of a diameter is gradually decreased from the rear side to the front side. To a rear end face of the gear holding part 71, the above-mentioned gear 50 is fixed so as to have the same axial center (refer to FIG. 5).

The fitting part main body 72 is arranged so as to separate from an inner circumference face of the circular gear 50. The fitting part main body 72 has a fitting rotation shaft part 73 formed in a hollow cylindrical shape and a fitting contact part 74 provided around an outer circumference face of the fitting rotation shaft part 73.

The fitting rotation shaft part 73 has the same axial center as the fitting contact part 74 and is extended backwardly from the axial center portion of the fitting contact part 74. The fitting rotation shaft part 73 is inserted into a hollow portion of the fixing shaft 64 protruded from the rear cover 30*c*. Thereby, the fitting part 65 is rotatably supported between the lateral part 30*b* and cover 30*c*.

The fitting contact part 74 is formed in a body at a position shifted forwardly from a rear end face of the fitting rotation shaft part 73. The fitting contact part 74 is formed so as to have the roughly same external diameter as the fixing shaft 64. In a distal end part (a rear end part) of the fitting contact part 74, a circular contact face 75 is formed. The contact face 75 is formed so as to be inclined at the same angle as the distal end face of the above-mentioned fixing shaft 64. In a condition where the fitting rotation shaft part 73 is inserted into the fixing shaft 64, the fitting contact part 74 is pressed to a side of the fixing shaft 64 by the bias force of the coil part 62 of the biasing member 60. Therefore, the contact face 75 of the fitting contact part 74 always comes into slide contact with the distal end face 66 of the fixing shaft 64. Thereby, the fitting part 65 is rotatably supported by the fixing shaft 64 in a condition of making the contact face 75 come into contact with the distal end face 66.

Figure 10A:
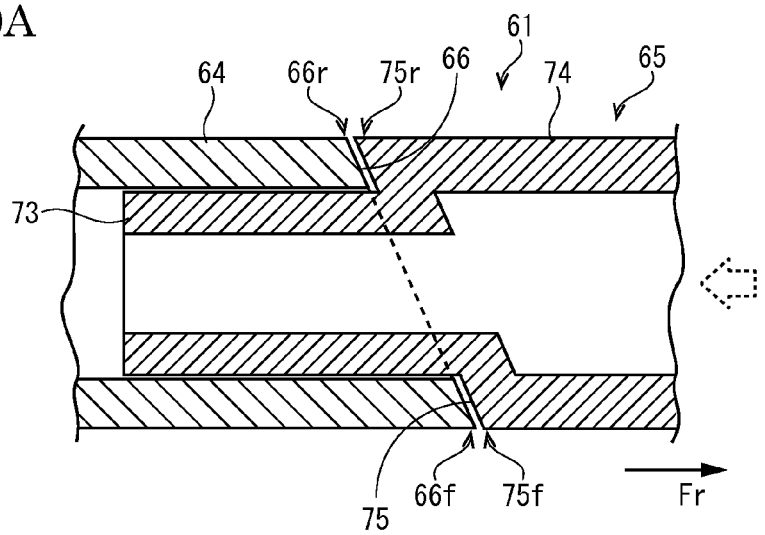
FIG. 10A is a sectional view schematically showing a displacing member in a condition, where a distal end face and a contact face are matched to each other.
Figure 10B:
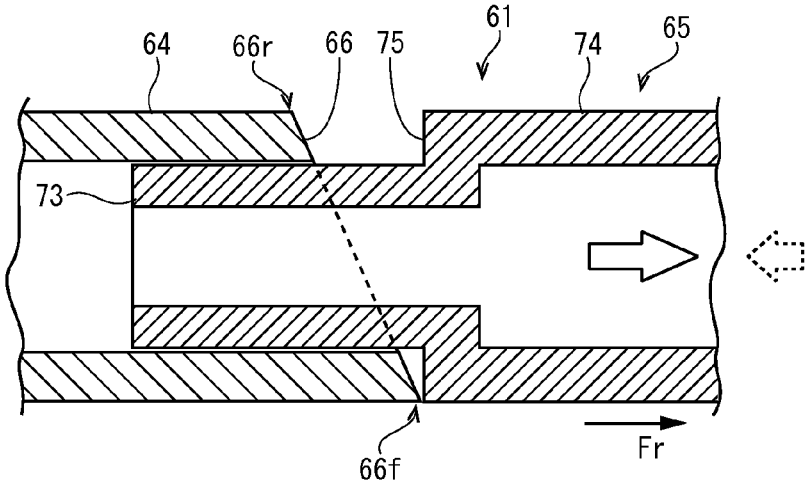
FIG. 10B is a sectional view schematically showing the displacing member in a condition, where the fitting part is rotated by approximately 90 degrees from the condition shown in FIG. 10A.
Figure 10C:
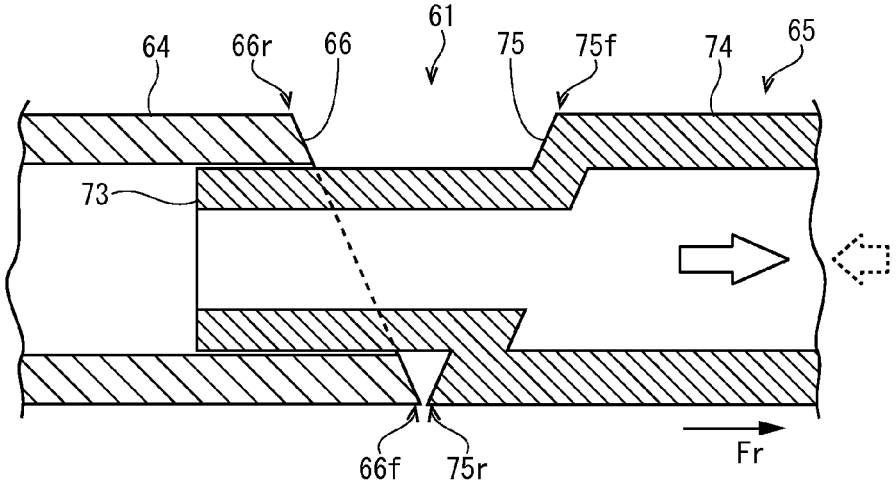
FIG. 10C is a sectional view schematically showing the displacing member in a condition, where the fitting part is rotated by approximately 180 degrees from the condition shown in FIG. 10A, in the developing device in accordance with the embodiment of the present disclosure.

Next, with reference to FIGS. 10A to 10C, an action of the moving mechanism 25 of the developing device 14 will be described. FIG. 10A is the explanatory drawing schematically illustrating a condition where the distal end face 66 and contact face 75 of the displacing member 61 of the developing device 14 are matched to each other. FIG. 10B is the explanatory drawing schematically illustrating a condition where the fitting part 65 is rotated by approximately 90 degrees from the condition shown in FIG. 10A. FIG. 10C is the explanatory drawing schematically illustrating a condition where the fitting part 65 is rotated by approximately 180 degrees from the condition shown in FIG. 10A.

A drive force from the driving device 47 drives and rotates the first agitating screw 22 via the gear 50. The bias member 60 attached to the rotation axis part 43 is turned in the same direction in accordance with the rotation of the first agitating screw 22 (refer to an arrow in FIG. 4). The cleaning part 63 of the biasing member 60 is slid on the inside face of the front lateral wall part 30*b* so as to draw an arc. The cleaning part 63 scrapes off the developer stayed and adhered onto the detection face 56 by sliding on the detection face 56 of the detecting device 26.

As described above, when the biasing member 60 is rotated together with the first agitating screw 22, the cleaning part 63 passes through over the detection face 56 of the detecting device 26. Thereby, since it is possible to clean the developer adhered onto the detection face 56 by the cleaning part 63, the detecting device 26 can correctly detect the developer amount inside the housing 20.

The moving mechanism 25 reciprocates the first agitating screw 22 in the rotation axis direction (the forward and backward directions) in accordance with the rotation of the first agitating screw 22 by cooperation of the biasing member 60 and displacing member 61.

In detail, the biasing member 60 always biases the first agitating screw 22 backwardly (refer to broken line arrows in FIGS. 10A to 10C). On the other hand, the contact face 75 of the fitting part 65 of the displacing member 61 is rotated and slid on the distal end face 66 of the fixing shaft 64 in accordance with the rotation of the first agitating screw 22. Therefore, an inclination direction of the contact face 75 of the fitting part 65 is varied with regard to an inclination direction of the distal end face 66 of the fixing shaft 64 in accordance with the rotation.

For example, in a condition where the inclination directions of the distal end face 66 and contact face 75 are matched to each other (refer to FIG. 10A), when the fitting part 65 (the first agitating screw 22) is rotated, the inclination direction of the contact face 75 begins to shift in the rotation direction (a circumferential direction) with regard to the inclination direction of the fixed distal end face 66. That is, a rearmost part 75*r* of the contact face 75 is rotated and slid from a rearmost part 66*r* to a foremost part 66*f* of the distal end face 66. The shifting of the inclination direction is converted to a force moving the first agitating screw 22 forwardly. Thereby, the agitating member is moved forwardly against the bias force of the biasing member (refer to FIG. 10B).

When the rotation is advanced and the rotation phase from the condition, where the inclination directions of the distal end face 66 and contact face 75 are matched to each other, becomes 180 degrees, the first agitating screw 22 becomes a condition being moved at a foremost side. That is, the rearmost part 75*r* of the contact face 75 becomes a condition coming into contact with the foremost part 66*f* of the distal end face 66 (refer to FIG. 10C).

When the rotation is further advanced, the first agitating screw 22 is moved backwardly by the bias force of the biasing member 60 (the coil part 62). Subsequently, when the rotation phase becomes 360 degrees, the fitting part 65 becomes the condition where the inclination directions of the distal end face 66 and contact face 75 are matched to each other, again (refer to FIG. 10A). As described above, when the first agitating screw 22 (the fitting part 65) makes one rotation, the first agitating screw 22 makes one reciprocation. When such a reciprocation action of the first agitating screw 22 is repeated, the first agitating screw 22 vibrates in the rotation axis direction. Incidentally, in each face 66, 75, a distance between the foremost part 66*f*, 75*f* and rearmost part 66*r*, 75*r* is set to approximately 5 mm. That is, the first agitating screw 22 is moved by approximately 5 mm in the rotation axis direction.

As described above, by the moving mechanism 25 simply constituted of minimum members, it is possible to carry out the reciprocation (vibration) in the rotation axis direction of the agitating member accompanying to the rotation of the first agitating screw 22 in positive motion.

In accordance with the developing device 14 according to the embodiment described above, the first agitating screw is reciprocated in the rotation axis direction by the moving mechanism 25, while being rotated inside the housing 20. Therefore, the first agitating screw 22 vibrates evenly along the conveying direction of the developer. According to this, the developer adhered onto the first agitating screw 22 (the rotation axis part 43 and screw blade 44) is shaken from the first agitating screw 22 along the conveying direction. Thereby, since the function of agitating and conveying the developer of the first agitating screw 22 can be suitably preserved, it is possible to prevent charging failure of the developer in the housing 20 and to restrain deterioration of the developer. Moreover, since the first agitating screw 22 vibrates evenly in the rotation axis direction, it is possible to restrain agglomeration (shaft thickening) of the developer to the first agitating screw 22 (the rotation shaft part 43) and to suitably convey the developer by the rotation of the first agitating screw 22. Thereby, it is possible to prevent misdetection of the developer amount by the detecting device 26 and to suitably maintain the developer amount inside the housing 20.

In addition, in accordance with the developing device 14 according to the embodiment, in the fitting part 65 of the displacing member 61, the gear 50 transmitting the rotation force from the driving device 47 to the first agitating screw 22 is provided. Therefore, the driving device 47 can rotate the fitting part 65 and first agitating screw 22 integrally via the gear 50. Thereby, it is possible to use the driving device 47 rotating the first agitating screw 22 as a component reciprocating the first agitating screw 22 in the rotation axis direction and to simply construct the entire developing device 14 at a low cost.

In the developing device 14 according to the embodiment, as one example, the moving mechanism 25 is provided in order to vibrate the first agitating screw 22, but the present disclosure is not restricted by this. For example, the moving mechanism 25 may be configured so as to vibrate the conveying screw 21 and second agitating screw 23. That is, the moving mechanism 25 may vibrate at least one of the screws 21, 22, 23.

The inclination directions and inclined angles of the distal end face 66 and contact face 75 may be determined optionally. The moving distance of the first agitating screw 22 may be determined optionally.

In the developing device 14 according to the embodiment, the permeability sensor is applied to the detecting device 26, but a sensor applied to the detecting device 26 is not restricted by this. For example, instead of the permeability sensor, a piezoelectric sensor or an optical sensor may be applied.

Although the developing device 14 according to the embodiment was applied to the printer 1, in another embodiment, the configuration of the present disclosure may be applied to another image forming apparatus, such as a copying machine, a facsimile or a multifunction peripheral. Although the printer 1 according to the embodiment is a monochrome printer, in another embodiment, the configuration of the present disclosure may be applied to a developing device of a color printer.

While the preferable embodiment and its modified example of the developing device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A developing device comprising:

a case containing a developer inside;

an agitating member being rotated in the case to agitate the developer while conveying the developer in a rotation axis direction;

a moving mechanism reciprocating the agitating member in the rotation axis direction in accordance with the rotation of the agitating member; and a detecting device detecting a developer amount contained in the case;

wherein the moving mechanism includes:

a biasing member arranged at one side in the rotation axis direction of the agitating member so as to bias the agitating member to another side in the rotation axis direction; and a displacing member arranged at the other side in the rotation axis direction of the agitating member so as to displace the agitating member in the rotation axis direction in accordance with the rotation of the agitating member, the displacing member has:

a fixing shaft protruded from the case to the one side in the rotation axis direction; and a fitting part arranged in an end part at the other side in the rotation axis direction of the agitating member, the fitting part has a contact face coming into slide contact with a distal end face of the fixing shaft and is rotatably supported by the fixing shaft in a condition of making the contact face come into contact with the distal end face, the contact face and distal end face is formed so as to be inclined.

2. The developing device according to claim 1, wherein the detecting device is arranged at the one side in the rotation axis direction of the case, the biasing member has:

a coil part formed by helically coiling a wire and attached to a rotation shaft part of the agitating member so as to make a bias force act on the agitating member; and a cleaning part extended from the coil part to the outside in a radial direction so as to clean a detection face of the detecting device in accordance with the rotation of the agitating member.

3. The developing device according to claim 1, wherein in the fitting part of the displacing member, a gear transmitting a rotation force from the drive device is arranged.

4. The developing device according to claim 3, wherein the fitting part has:

a screw fitting shaft part fixed to a axial center of the agitating member;

a gear holding part, to which the circular gear is fixed, arranged in an end part at the other side in the rotation axis direction of the screw fitting shaft part; and a fitting part main body extended to the other side in the rotation axis direction of the gear holding part, the screw fitting shaft part, gear holding part and fitting part main body are formed in a body so as to have the same axial center, the fitting part main body has:

a fitting rotation shaft part formed in a hollow cylindrical shape and inserted into a hollow portion of the fixing shaft; and a fitting contact part provided around an outer circumference face of the fitting rotation shaft part at a position shifted to the one side from an end part at the other side in the rotation axis direction of the fitting rotation shaft part, in an end part at the other side in the rotation axis direction of the fitting contact part, the circular contact face is formed.

5. An image forming apparatus comprising:

a developing device including:

a case containing a developer inside;

an agitating member being rotated in the case to agitate the developer while conveying the developer in a rotation axis direction;

a moving mechanism reciprocating the agitating member in the rotation axis direction in accordance with the rotation of the agitating member; and a detecting device detecting a developer amount contained in the case;

wherein the moving mechanism includes:

a biasing member arranged at one side in the rotation axis direction of the agitating member so as to bias the agitating member to another side in the rotation axis direction; and a displacing member arranged at the other side in the rotation axis direction of the agitating member so as to displace the agitating member in the rotation axis direction in accordance with the rotation of the agitating member, the displacing member has:

a fixing shaft protruded from the case to the one side in the rotation axis direction; and a fitting part arranged in an end part at the other side in the rotation axis direction of the agitating member, the fitting part has a contact face coming into slide contact with a distal end face of the fixing shaft and is rotatably supported by the fixing shaft in a condition of making the contact face come into contact with the distal end face, the contact face and distal end face is formed so as to be inclined.

* * * * *